US007178447B2

(12) United States Patent
Koskimäki et al.

(10) Patent No.: US 7,178,447 B2
(45) Date of Patent: Feb. 20, 2007

(54) CONTROL VALVE AND A METHOD FOR A PERCUSSION DEVICE WITH A WORKING CYCLE INVOLVING SEVERAL COUPLING MOMENTS

(75) Inventors: Antti Koskimäki, Tampere (FI); Markku Keskiniva, Tampere (FI); Jorma Mäki, Mutala (FI); Mauri Esko, Ikaalinen (FI); Erkki Ahola, Kangasala (FI); Aimo Helin, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 11 days.

(21) Appl. No.: 10/546,245

(22) PCT Filed: Feb. 23, 2004

(86) PCT No.: PCT/FI2004/000081

§ 371 (c)(1),
(2), (4) Date: Aug. 19, 2005

(87) PCT Pub. No.: WO2004/073932

PCT Pub. Date: Sep. 2, 2004

(65) Prior Publication Data

US 2006/0169468 A1 Aug. 3, 2006

(30) Foreign Application Priority Data

Feb. 21, 2003 (FI) ..... 20030263

(51) Int. Cl.
*F01B 25/02* (2006.01)
*F01L 27/00* (2006.01)

(52) U.S. Cl. ..... 91/7; 91/218; 91/235; 91/321

(58) Field of Classification Search ..... 91/218, 91/7, 235, 321
See application file for complete search history.

(56) References Cited

U.S. PATENT DOCUMENTS 3,596,562 A * 8/1971 Foster et al. ..... 91/235
4,020,747 A * 5/1977 Reynolds ..... 91/298

* cited by examiner

*Primary Examiner*—Igor Kershteyn
(74) *Attorney, Agent, or Firm*—Drinker Biddle & Reath

(57) ABSTRACT

The invention relates to a control valve, a percussion device and a method of controlling a working cycle of a percussion device. A percussion device (1) for breaking rock includes an impact element (8) controlled by a control valve (2). The control valve includes a control element (5) arranged to control channels (7*b*) leading to a working pressure surface (9) of the impact element (8). The control element, during a working cycle of the control valve, is arranged to open and close pressure channels at several connecting moments so that during one working cycle of the valve, several impact pulses are arranged to be produced.

25 Claims, 4 Drawing Sheets

CONTROL VALVE AND A METHOD FOR A PERCUSSION DEVICE WITH A WORKING CYCLE INVOLVING SEVERAL COUPLING MOMENTS

BACKGROUND OF THE INVENTION

The invention relates to a control valve which is back-and-forth movable in its longitudinal direction, the control valve being arranged to open and close pressure channels leading to a percussion device. The invention further relates to a method of controlling a working cycle of a percussion device, and to a percussion device for breaking rock.

In rock breaking, percussion hammers and rock drills are used that are equipped with a percussion device for issuing impact pulses to the rock through a tool. A percussion device comprises an impact element, such as a percussion piston, whose working pressure surfaces may be affected by a pressure medium and which impact element is arranged to produce the necessary impact pulses. The pressure medium affecting the impact element may be controlled by a control valve connected to open and close pressure medium channels. As is well known in the art, an increase in the impact frequency of a percussion device usually enhances the breaking of rock. However, the existing control valves restrict the increasing of the impact frequency.

BRIEF DESCRIPTION OF THE INVENTION

An object of the present invention is to provide a novel and improved control valve and a percussion device as well as a method of controlling a working cycle of a percussion device.

A control valve of the invention is characterized in that the working cycle of the control valve includes several connecting moments in order to open and close the pressure medium channels, and that one working cycle of the control valve from a first extreme position to a second extreme position and back is arranged to produce at least two impact pulses in the percussion device.

A method of the invention is characterized by opening and closing the pressure medium channels during one working cycle of the control valve at several connecting moments, and by producing at the percussion device several impact pulses per one working cycle of the control valve.

A percussion device of the invention is characterized in that a working cycle of the control valve includes several connecting moments in order to open and close the pressure medium channels, and that one working cycle of the control valve from a first extreme position to a second extreme position and back is arranged to produce at least two impact pulses in the percussion device.

The idea underlying the invention is that a control valve includes a control element which can be moved longitudinally in a first control direction and in a second control direction so that the control element, at connecting moments according to its working cycle, is arranged to open and close pressure medium channels, enabling a pressure medium affecting one or more working pressure surfaces of the impact element to be controlled. Furthermore, one back-and-forth movement of the control element, i.e. one working cycle, is arranged to open and close pressure medium channels at several connecting moments of the control element so that several impact pulses are produced at the percussion device per one working cycle of the valve. For instance 2, 4 or 6 impact pulses may be arranged to be produced per one working cycle of the control valve. At a connecting moment, the flow of a pressure medium may be arranged in one direction towards the percussion device or away from it. Alternatively, at one connecting moment the pressure medium may be arranged to flow along first channels towards the percussion device and along second channels away from the percussion device. At a connecting moment, the control valve is thus arranged to open a connection between at least two pressure medium channels.

An advantage of the invention is that when the working cycle of the control valve includes several connecting moments, the operating frequency of the valve may be several times lower than the operating frequency of the percussion device. In such a case, although the impact frequency of the percussion device were dimensioned very high, the operating frequency of the control valve may be reasonable. Furthermore, a control valve having a lower operating frequency is easier to construct and control. Furthermore, a valve having a lower operating frequency may wear less than a fast-operating valve.

The idea underlying an embodiment of the invention is that the control element is arranged to open two or more parallel pressure medium channels substantially simultaneously when the control element is moved in a first control direction and/or in a second control direction. In such a case, the pressure medium is allowed to flow along two or more different channels to one or more working pressure surfaces of the percussion device in order to produce an impact pulse. In the parallel channels, the direction of flow of the pressure medium is the same. Alternatively, in some percussion device applications, the control element may be used for conveying the pressure medium from the working pressure surface of the impact element along several parallel channels to a discharge channel and thus produce an impact pulse. The several parallel channels enable the volume flow passing through the valve to be large enough.

The idea underlying an embodiment of the invention is that the control valve is used by means of a pressure medium, e.g. hydraulically. The control valve comprises a frame and a sleeve-like control element. The control element is arranged in a space provided in the frame of the valve and it may be moved in an axial direction. The outer periphery of the control element is provided with several working pressure surfaces located in working pressure spaces surrounding the control element. The control element may be moved by affecting the pressure of a pressure medium in the working pressure spaces, and thus also the pressure affecting the working pressure surfaces. The control element further includes one or more apertures extending from the side of the outer surface of the sleeve to the side of the inner surface of the sleeve. Moving the control element in an axial direction enables the apertures to be positioned at and away from the pressure medium channels provided in the frame in order to control pressure medium flows.

The idea underlying an embodiment of the invention is that the control element of the control valve is used mechanically by bringing an external operating force thereto from at least one actuator.

The idea underlying an embodiment of the invention is that the control element of the control valve is used by means of a crank mechanism. The crank mechanism includes at least a crank and a connecting bar connected to the control element by suitable connecting elements. The crank mechanism may further comprise a flywheel.

The idea underlying an embodiment of the invention is that the size of apertures being connected at connecting moments during a working cycle is dimensioned such that at each connecting moment, the apertures are connected for a substantially equally long time, irrespective of the speed of the control element at the connecting moment. If the movement of the control element is not harmonic, the resulting disadvantages may be compensated for by dimensioning the apertures correctly.

The idea underlying an embodiment of the invention is that the position of apertures being connected at a connecting moment is dimensioned such that during a working cycle, the time difference between successive opening moments is substantially constant.

The idea underlying an embodiment of the invention is that the pressure medium is a hydraulic fluid.

BRIEF DESCRIPTION OF THE DRAWINGS

The invention will be described in closer detail in the accompanying drawings, in which.

For the sake of clarity, the figures show the invention in a simplified manner. Like reference numerals identify like elements.

DETAILED DESCRIPTION OF THE INVENTION

Figure 1:
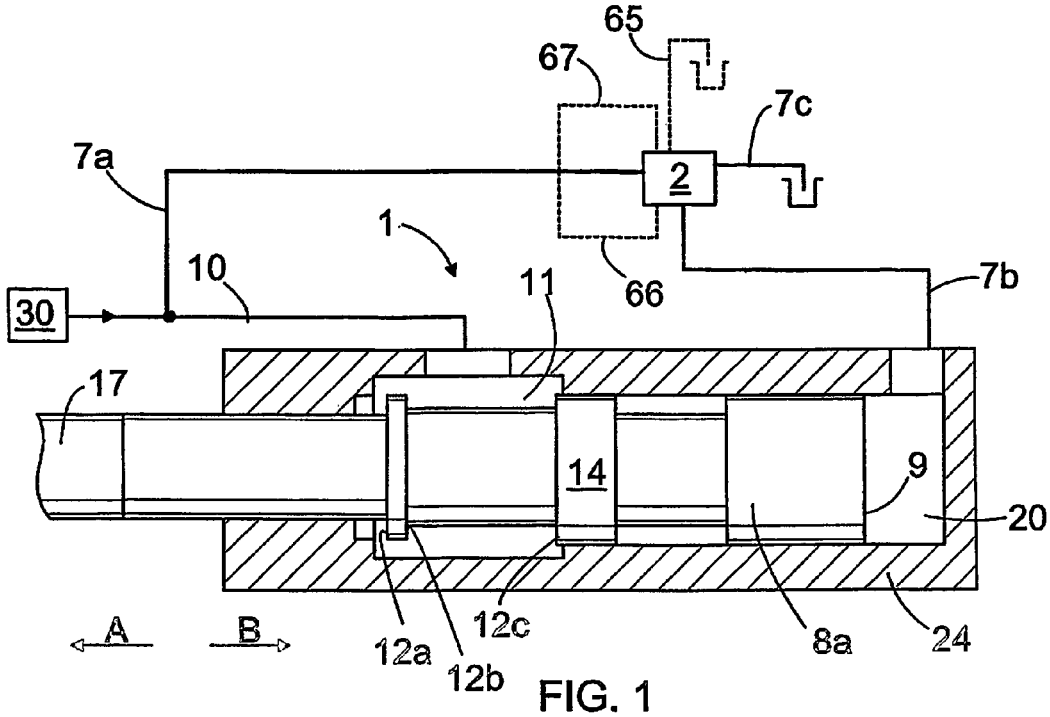
FIG. 1 is a schematic cross-sectional view showing a percussion device in a situation wherein a movable percussion piston is about to be returned for a new stroke.
Figure 2:
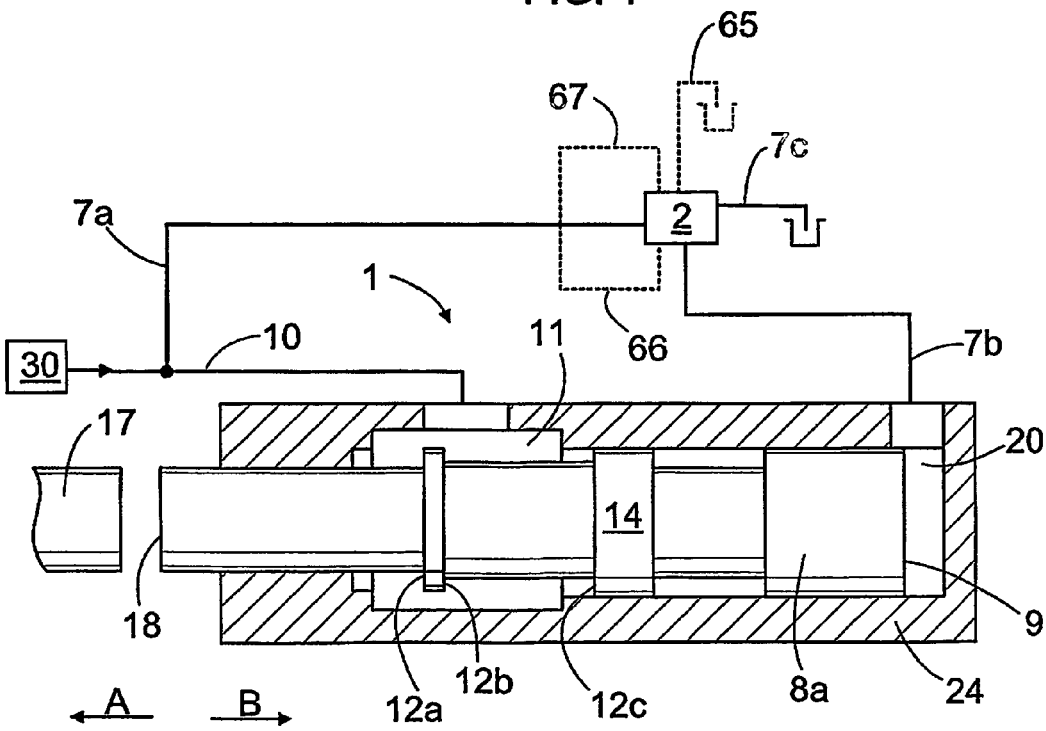
FIG. 2 is a schematic and cross-sectional view showing the percussion device of FIG. 1 in a situation wherein the percussion piston starts an impact movement.

FIGS. 1 and 2 illustrate the structure and operation principle of a percussion device 1. In this case, the percussion device 1 comprises a percussion piston 8*a* which, by means of a pressure medium, is movable back and forth in impact direction A and in return direction B, an impact surface 18 of the percussion piston being arranged to strike against a tool 17 located in the front of the percussion piston 8*a* and to produce an impact pulse onto the tool 17 in order to break rock. The percussion piston 8*a* thus operates as an impact element 8 producing impact pulses. A working cycle of the percussion piston 8*a* may be controlled by controlling, by means of a control valve 2, a pressure medium in a pressure space 20 affecting the percussion piston 8*a*. In some applications, a pressure effective in other pressure spaces, e.g. in a pressure space 11, may also be controlled. Typically, the pressure medium is a hydraulic fluid.

In FIG. 1, the percussion piston 8*a* has just struck against the tool 17, and the percussion piston 8*a* is about to be returned for a new stroke in return direction B. The control valve 2 has opened a connection from the pressure space 20 at the rear end of the percussion piston 8*a* to a channel 7*c* leading to a tank so that the pressure of the pressure medium does not substantially affect a working pressure surface 9 at the rear end of the percussion piston 8*a*. A connection is provided from a pressure source 30 through a channel 10 to the pressure space 11 around the percussion piston 8*a* so that the pressure of the pressure medium affects working pressure surfaces 12*a* to 12*c* of the percussion piston 8*a* that are dimensioned such that the percussion piston 8*a* starts a return movement in direction B.

In FIG. 2, the percussion piston 8*a* is about to start an impact movement in impact direction A. The control valve 2 has opened a connection from a channel 7*a* to a channel 7*b* and further to the pressure space 20 so that the pressure of the pressure medium fed from the pressure source 30 affects the working pressure surface 9. Working pressure surfaces towards impact direction A are dimensioned clearly larger than working pressure surfaces effective in return direction B of the percussion piston 8*a* so that the percussion piston 8*a* starts to move towards the tool 17 at a high acceleration rate and strikes against it.

It is completely clear to one skilled in the art that the percussion device 1 may also be implemented in a way other than that shown in FIGS. 1 and 2 for the sake of example. The impact element 8 may include several different shoulders and working pressure surfaces. Furthermore, the control valve 2 may be arranged to convey a pressure medium to all working pressure surfaces or to some working pressure surfaces only.

Figure 3:
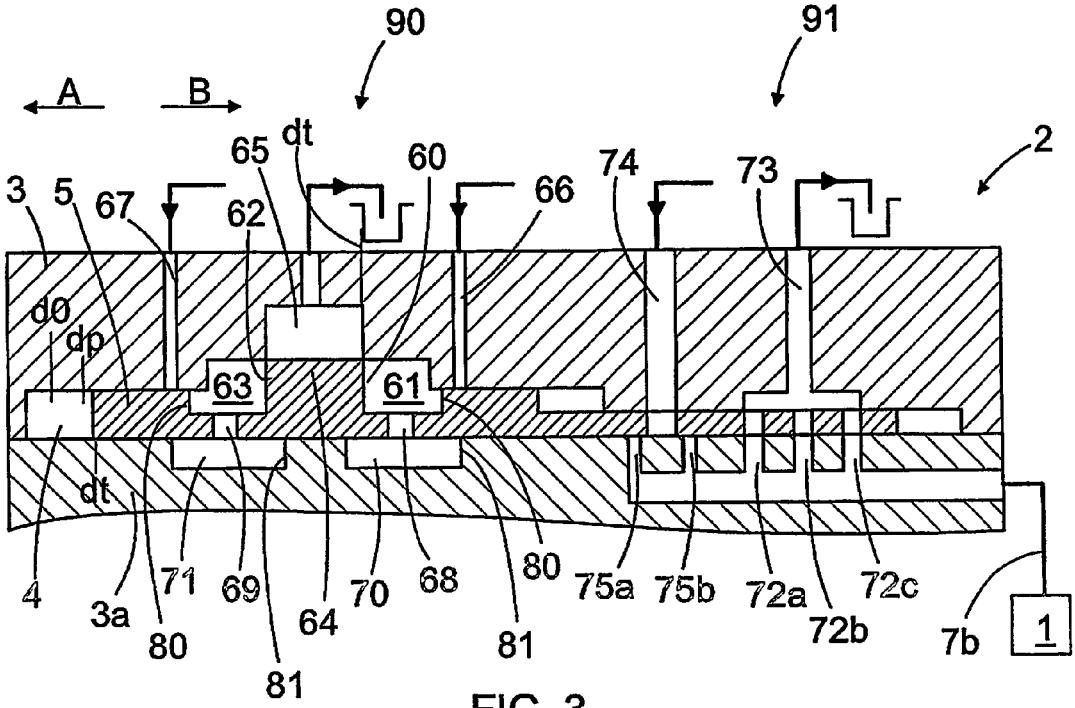
FIG. 3 is a schematic and cross-sectional view showing a control valve of the invention.

FIG. 3 shows an embodiment of the control valve 2 of the invention. Means for using the control valve 2 may be arranged in an operating part 90 provided over a section of a first end of the valve while means for controlling a pressure medium, i.e. connecting means, may be arranged in a control part 91 provided over a section of a second end of the valve. The control valve 2 comprises a frame 3 and a control element 5. The control element 5 may be an elongated sleeve-like piece which can be moved in an axial direction with respect to the frame 3. The control element 5 may include a first working pressure surface 60 effective in direction A and connected to a first working pressure space 61 of the control valve 2. The control element 5 may further include a second working pressure surface 62 effective in direction B and connected to a second working pressure space 63 of the control valve 2. The outer periphery of the control element 5 may include a shoulder 64 which, when the control element 5 is moved in an axial direction, may open and close a connection from the working pressure spaces 61, 63 to a discharge channel 65. Furthermore, the movement of the control element 5 in an axial direction is arranged to open and close a connection from a first control pressure channel 66 to the first working pressure space 61. Similarly, the control element 5 may be arranged to open and close a connection from a second control pressure channel 67 to the second working pressure space 63. As can be seen in FIG. 3, the outer periphery of the sleeve may be provided with recesses on both sides of the shoulder 64. The recesses enable the volume of the working pressure spaces 61 and 63 to be increased. Furthermore, the working pressure spaces 61 and 63 may, by means of connecting channels 68 and 69, be connected to additional spaces 70 and 71 provided in a frame part 3*a* inside the sleeve. The purpose of the additional spaces 70 and 71 is to increase the volume of the working pressure spaces 61 and 63. In some cases, recesses 80 provided in the control element 5 only or, alternatively, additional spaces 70, 71 only, may increase the volume of the working pressure spaces 61, 63 sufficiently. When the working pressure spaces 61 and 63 have a sufficiently large volume, pressure energy may be stored therein to be utilized in moving the control element 5 in an axial direction in a manner to be shown below. In FIG. 3, the control element 5 is shown in a middle position, from which it may be moved to its first extreme position in direction A and, correspondingly, in its second extreme position in direction B. The control element 5 may thus carry out a control function in both its extreme positions as well as in the middle position.

The control element 5 of FIG. 3 may be provided with several parallel discharge channels 72*a* to 72*c*, along which the pressure medium is allowed to flow from the percussion device 1 to a channel 73 leading to a tank when the control element 5 is in the middle position. If the control element 5 is moved from the middle position in direction A or B, a connection from the parallel discharge channels 72*a* to 72*c* to the channel 73 closes. At the same time, a connection from a pressure channel 74 to a working pressure channel 75*a* or 75*b* opens. A working cycle of the control valve 2 of FIG. 3 thus includes several connecting moments. When the control valve 2 of FIG. 3 moves from a first extreme position to a second extreme position, two control functions may take place during this one-way movement from left to right: in the first extreme position, the pressure medium is allowed to proceed to the percussion device 1 along the working pressure channel 75*a*; in the middle position, the pressure medium is allowed to discharge from the percussion device 1 to a tank along the parallel discharge channels 72*a* to 72*c*; and further, in the second extreme position, the pressure medium is fed to the percussion device 1 along the channel 75*b*. The control valve 2 may be connected to the percussion device 1 such that one movement of the control element 5 in an axial direction in direction A or B produces one impact pulse in the percussion device 1. Thus, the operating frequency of the percussion device 1 may be double compared with the operating frequency of the control valve 2. If a working cycle of the control valve is provided with several connecting moments, it is possible to produce in the percussion device 1 even a larger and even number of impacts per one working cycle of the control valve 2. In such a case, the ratio of the operating frequency of the control valve 2 may be even smaller with respect to the impact frequency of the percussion device 1, e.g. one fourth, one sixth, etc. The number of parallel and substantially simultaneously opening discharge channels 72*a* to 72*c* may be dimensioned so that the parallel channels together form a sufficiently large cross-sectional area to enable the necessary flow to be conveyed through the valve quickly.

The control valve 2 shown in FIG. 3 may be arranged to change the position independently with no external control. When the control element 5 is in the first extreme position, i.e. it has moved to the left, the second working pressure space 63 is connected to the second control pressure channel 67. Since the first working pressure space 61 is then connected to the discharge channel 65, the control element 5 is subjected to a force that tries to move it in direction B. At the same time, pressure energy is stored in the second working pressure space 63 and in the additional space 71 thereof. When the control element 5 moves from an extreme position d0 in direction B to a predetermined point dp, the connection from the second control pressure channel 67 to the second working pressure space 63 closes. In this situation, the connection from the second working pressure space 63 to the discharge channel 65 is still closed. The pressure energy stored in the second working pressure space 63 makes the control element 5 continue its movement in direction B. Thus, this means that the compressed pressure medium in the second working pressure space 63 expands so that the pressure energy converts into kinetic energy. When the control element 5 reaches a predetermined point dt, the shoulder 64 opens the connection from the second working pressure space 63 to the discharge channel 65. When the control element 5 further moves in direction B past the middle position, the shoulder 64 closes the connection from the first working pressure space 61 to the discharge channel 65. The result is that when the control element 5 moves further to the right, the pressure in the first working pressure space 61 increases. When the control element 5 further continues the movement in direction B, the connection from the first working pressure space 61 to the first control pressure channel 66 opens. Thus, the pressure medium effective in the first working pressure space 61 may penetrate into the first control pressure channel 66. The kinetic energy of the control element 5 decreases continuously when the control element moves towards its extreme position. A force affecting the first working pressure surface 60 of the control element 5 finally stops the control element 5 and makes it change its direction of movement. The control element 5 then starts to accelerate its speed in opposite direction A. Since the structure and operation of the control valve are arranged to be symmetrical in both movement directions, the above-described phases are repeated. The control element 5 continues the back-and-forth movement with no external control as long as a pressure medium is fed to the control pressure channels 66 and 67.

Figure 4:
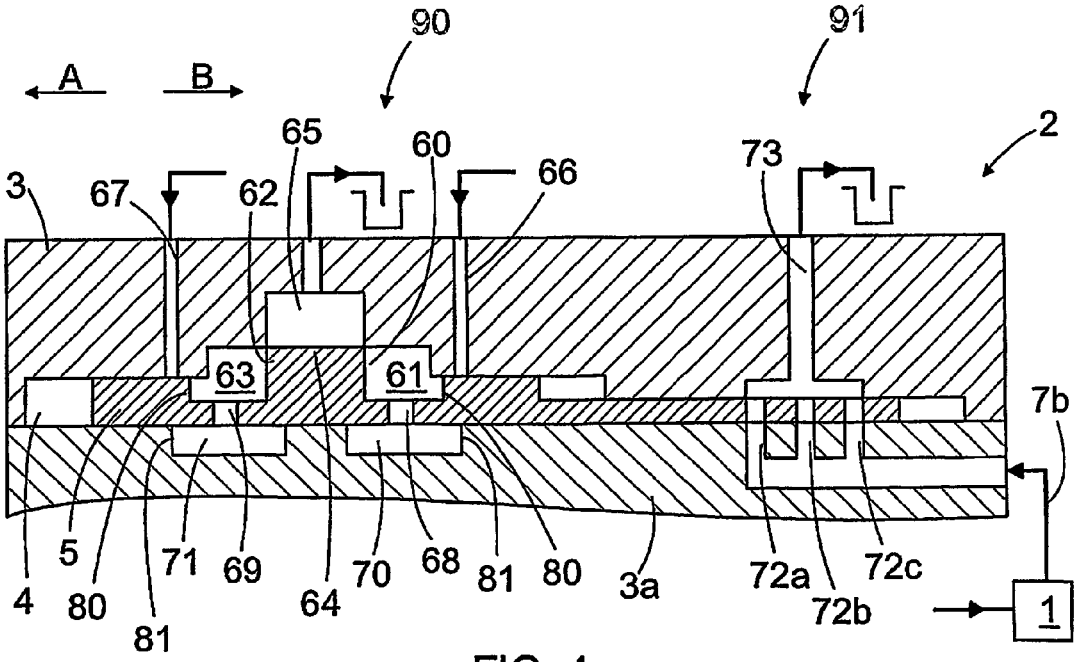
FIG. 4 is a schematic and cross-sectional view showing a second control valve of the invention.

In the control valve 2 of FIGS. 3 and 4, the movement of the control element 5 in the extreme positions may be damped by means of closed pressure spaces. The control element 5 is thus not stopped mechanically, in which case the surfaces in an axial direction of the control element 5 and the frame 3 are subjected to no wearing mechanical strain.

A control valve 2 shown in FIG. 4 may be arranged to perform a back-and-forth movement between its extreme positions in a manner similar to that of the control valve shown in FIG. 3. The difference from the solution of FIG. 3 is that the control element 5 is only arranged to open and close parallel discharge channels 72*a* to 72*c* in order to convey the pressure medium from the percussion device 1 to the channel 73 leading to a tank. The percussion device 1 may be continuously connected to a pressure source, from which the pressure medium is fed to one or more working pressure surfaces in the impact element. Impact pulses necessary for breaking rock may be produced by allowing the pressure medium affecting the impact element to discharge into the tank abruptly.

Furthermore, in connection with the pressure-controlled control valve 2 there may be provided means for ensuring that the control element 5 will not remain in its middle position when the valve 2 has been stopped. Due to the influence of these means, the control element 5 is arranged to move in one of its extreme positions so that when the pressure of the pressure medium is again conveyed to the valve 2, it starts to move back and forth according to its working cycle.

Since the control valve 2 of FIGS. 3 and 4 requires no external control, the working cycle of the percussion device 1 is simple to control, and the structure of the control valve 2 may be relatively simple. In addition, the operation of the control valve 2 may be affected in a versatile manner by dimensioning the aforementioned opening points dp and dt appropriately, and further by affecting the pressure effective in the control pressure channels 66 and 67. Another advantage of the solutions disclosed in FIGS. 3 and 4 is small pressure losses. This is because the points dp and dt may be dimensioned so that the connection from the control pressure channels 66 and 67 to the working pressure spaces 61 and 63 opens only after the pressure effective in the working pressure spaces 61 and 63 has, due to the movement of the control element 5, increased to correspond to the pressure effective in the control pressure channels 66 and 67. In addition, the points dp and dt may be dimensioned so that the connection from the working pressure spaces 61 and 63 to the discharge channel 65 opens only after the pressure in the working pressure spaces 61 and 63 has decreased to substantially correspond to the tank pressure.

Instead of the sleeve shown in FIGS. 3 and 4, the control element 5 may also be a different longitudinally movable piece. The control element 5 may be e.g. a slide or a pin, in which case the control valve 2 may be a valve of a spool valve type. Also in this case, the control element 5 may comprise a middle position as well as a first extreme position and a second extreme position. The parallel pressure/discharge channels may be arranged to connect in the middle position or in the extreme positions of the control element 5. Furthermore, if even more connecting moments are provided, a section between the middle point and an extreme position may be provided with one or more connecting moments.

In the control valve 2 according to the idea of the invention, one back-and-forth movement of the control element 5 is arranged to open and close pressure medium channels so that several impact pulses, e.g. 2, 4 or 6 impact pulses, are produced in the percussion device 1 per one working cycle of the valve. This enables the operating frequency of the control valve 2 to be decreased. On the other hand, by using such a control valve enabling several impact pulses per one working cycle of the valve, the impact frequency of the percussion device 1 may be increased without the operating frequency of the control valve 2 becoming a limiting factor. The movement of the control element 5 in an axial direction may be dimensioned e.g. according to the number of connecting moments provided in a working cycle of the valve: the larger the number of connecting moments, the longer the movement of the control element 5 may be. Furthermore, since the speed of the control element 5 may be different at different connecting moments, the size of the channels provided in the frame 3 of the control valve may be dimensioned such that at each connecting moment, a channel is open for a substantially equally long time.

Depending on the structure of the percussion device, a control valve whose control element is arranged to move between the middle and extreme positions may be either arranged to convey the pressure medium flow along the parallel channels away from the working pressure surface of the percussion device or arranged to convey the flow on to the working pressure surface in order to produce impact pulses.

Figure 5:
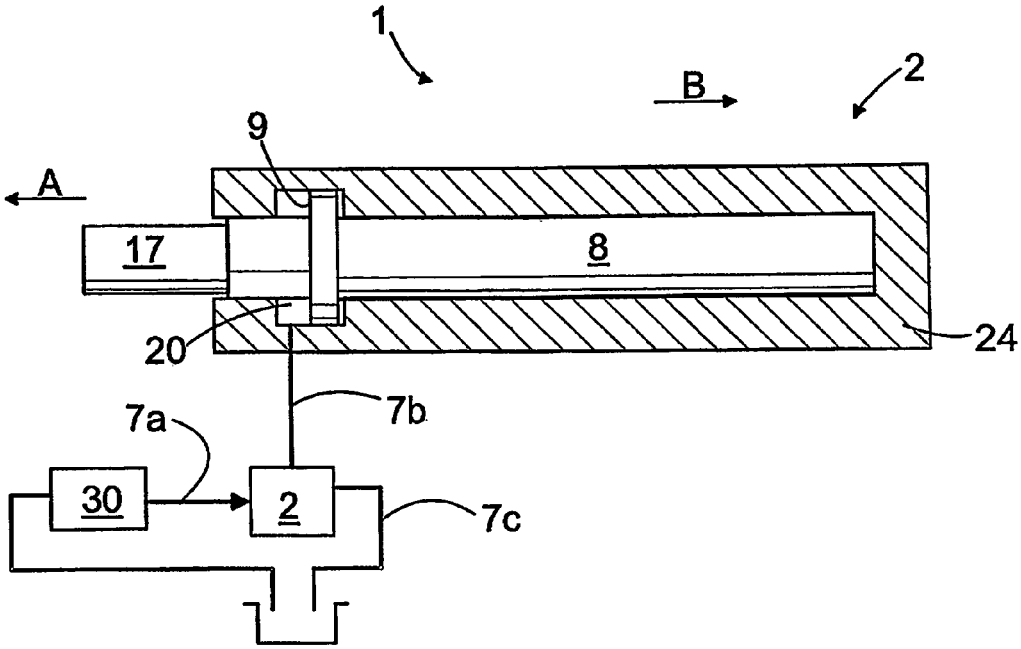
FIG. 5 is a schematic and cross-sectional view showing a percussion device wherein an abrupt departure of the pressure of a pressure medium from a pressure surface of an impact element is arranged to produce an impact pulse, FIG. 6 schematically shows a control device of the invention and its use by means of a crank mechanism, FIG. 7 schematically shows curves of speed and position in a situation wherein a control valve of the invention is arranged to produce two impact pulses per one working cycle of the valve, FIG. 8 schematically shows curves of speed and position in a situation wherein a control valve of the invention is arranged to produce four impact pulses per one working cycle of the valve, and FIG. 9 schematically shows curves of speed and position in a situation wherein a control valve of the invention is arranged to produce six impact pulses per one working cycle of the valve.

FIG. 5 shows, highly simplified, a "compression bar percussion device". In such a percussion device 1, an impact element is not moved back and forth by means of a pressure medium but impact pulses are produced by varying the pressure of the pressure medium on a working surface 9 of the impact element 8. The pressure of the pressure medium is conveyed to a working pressure space 20 by means of a control valve 2 so that the impact element 8 pushes its way in direction B against a frame 24 and compresses. In this application, the impact element 8 operates as a compression bar. When the pressure of the pressure medium effective on the pressure surface 9 of the impact element is, by means of the control valve 2, allowed to discharge very quickly away from the working pressure space 20, the impact element 8 obtains its original length so that it produces an impact pulse against a tool 17. Using the control valve 2 of the invention, whose working cycle is provided with several connecting moments per one working cycle of the valve, enables a very high impact frequency to be achieved for the compression bar percussion device. The control valve's 2 own operating frequency may, however, be several times lower than the impact frequency of the percussion device.

Figure 6:
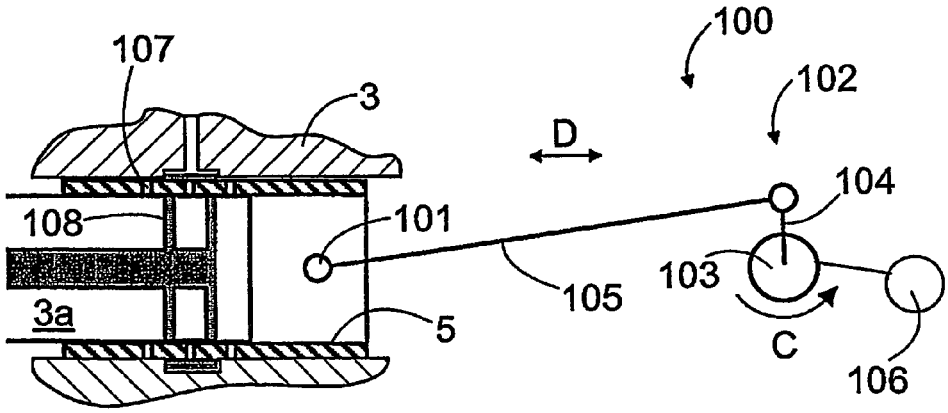

FIG. 6 illustrates an embodiment for using the control valve 2 of the invention. In this case, the control element 5 is not moved in an axial direction by means of a pressure medium but it may be used mechanically by means of an actuator 100. An external force produced by the actuator 100 may be directed at connecting elements 101, such as a bearing journal, provided in the control element 5. The actuator 100 may be e.g. a crank mechanism 102 which may comprise a flywheel 103, a crank 104 as well as a connecting bar 105. As is well known, a crank mechanism 102 enables a rotary movement C to be converted into a back-and-forth linear movement D, and vice versa. The length of the movement made by the control element 5 in direction D may be affected by the length of the crank 104. Furthermore, the rotation speed of the flywheel 103 enables the operating frequency of the control valve 2 to be affected, the operating frequency, again, directly affecting the impact frequency of the percussion device 1. The flywheel 103 may be provided with a rotating moment e.g. by means of a pressure-medium-operated rotating motor 106. Due to the crank mechanism 102, the operating power required by the control valve 2 may be low. When the control element 5 is slowed down in the extreme positions of the movement, kinetic energy of the control element 5 is stored as kinetic energy of the crank mechanism 102. When the control element 5 is again accelerated from an extreme position towards the middle position, the kinetic energy stored in the crank mechanism 102 may be transferred to the control element 5. Most advantageously, the rotating motor 106 is only needed to overcome frictional power.

The crank mechanism 102 shown in FIG. 6 is incapable of producing a perfect harmonic movement. This can be taken into account when dimensioning the size and position of the apertures to be opened by the control element 5. Further, if the connecting bar 105 is dimensioned clearly longer than the crank 104, the movement of the control element 5 may be close enough to a harmonic movement.

The control element of the control valve of the invention may be used by a pressure medium, e.g. by a hydraulic fluid; mechanically, e.g. by a crank mechanism; electrically, e.g. by a solenoid; or alternatively in any other suitable manner. The point is that the control element is moved back and forth using a suitable means or an actuator so that at the several connecting moments according to a working cycle of the control valve, the flow channels open and close, producing in the percussion device several impact pulses per one working cycle of the valve.

Figure 7:
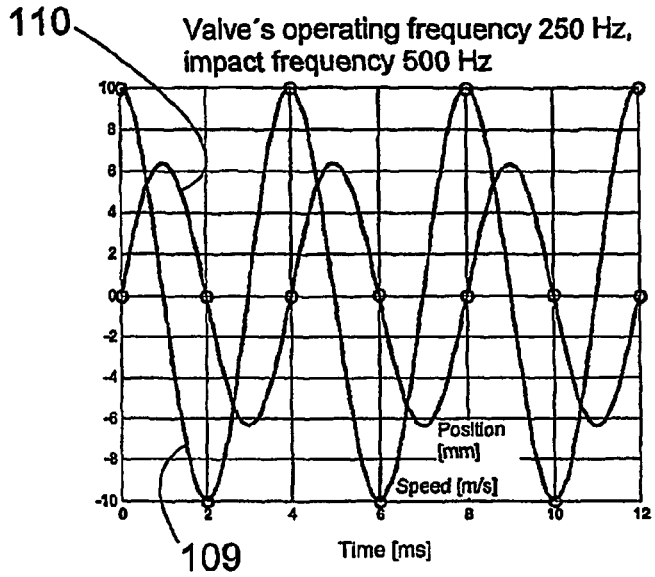

A speed curve 109 and a position curve 110 shown in FIG. 7 relate to a control valve 2 enabling two impact pulses to be produced per one working cycle of a control element 5. Such a control valve 2 is shown e.g. in FIGS. 3 and 4. In the situation of FIG. 7, the impact frequency of a percussion device 1 is set to be 500 Hz. Since two impact pulses are produced in the percussion device 1 during one working cycle of the control valve 2, the operating frequency of the control valve 2 is half the impact frequency, i.e. 250 Hz. A designation o is used in FIG. 7 to indicate the connecting moments of the control valve 2 at which the control element 5 connects channels. The speed of the control element 5 at the connecting moment is 10 m/s and the amplitude of the position of the control element is 6.4 mm.

Figure 8:
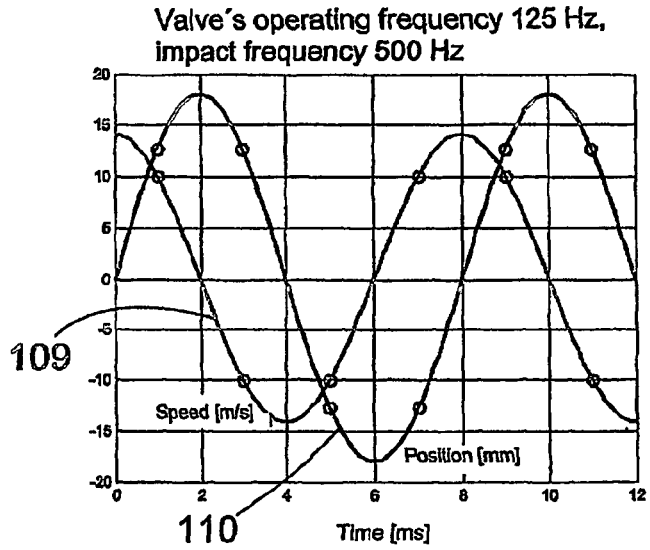

A speed curve 109 and a position curve 110 shown in FIG. 8 relate to a control valve 2 enabling four impact pulses to be produced per one working cycle of a control element 5. Such a control valve 2 is shown e.g. in FIG. 6. The control element 5 may be provided with three apertures 107 and a frame part 3*a* may be provided with two apertures 108. Alternatively, the control element 5 may be provided with two apertures 107 and the frame part 3*a* may be provided with three apertures 108. In the situation of FIG. 8, the impact frequency of a percussion device 1 is set to be 500 Hz. Since four impact pulses are produced in the percussion device 1 during one working cycle of the control valve 2, the operating frequency of the control valve 2 is only one fourth of the impact frequency, i.e. 125 Hz. A designation o is used in FIG. 8 to indicate the connecting moments of the control valve 2 at which the control element 5 connects the apertures 107 and 108. The speed of the control element 5 at the connecting moment is 10 m/s and the amplitude of the position of the control element is 18.6 mm.

When a larger number of impact pulses is produced per one working cycle of the valve, it may be advantageous to increase the amplitude of the movement of the control element 5. This ensures that the speed of the control element 5 is sufficiently high at the connecting moment. Furthermore, when the amplitude of the control element 5 is increased, the control valve 2 may be dimensioned such that the sealing surfaces of the valve are sufficiently long so as to avoid internal leakages in the valve.

Figure 9:
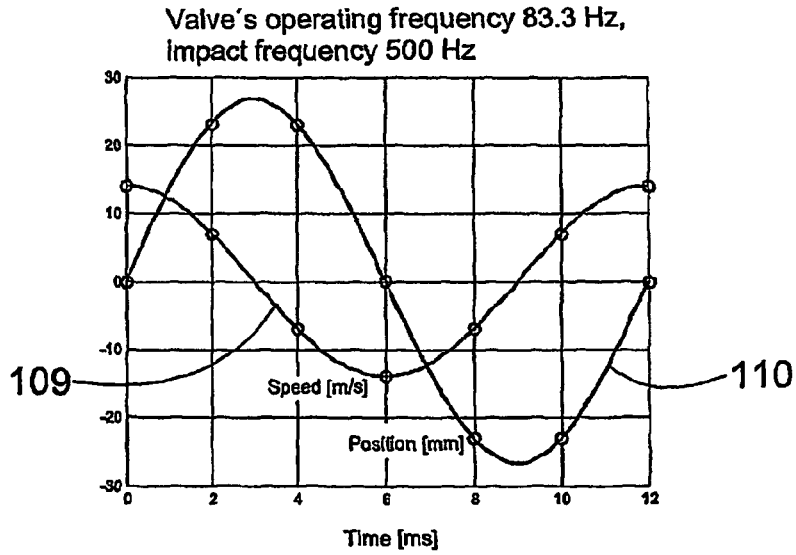

A speed curve 109 and a position curve 110 shown in FIG. 9 relate to a control valve 2 enabling six impact pulses to be produced per one working cycle of a control element 5. In the situation of FIG. 9, the impact frequency of a percussion device 1 is set to be 500 Hz. Since six impact pulses are produced in the percussion device 1 during one working cycle of the control valve 2, the operating frequency of the control valve 2 is only one sixth of the impact frequency, i.e. 83.3 Hz. A designation o is used in FIG. 9 to indicate the connecting moments of the control valve 2 at which the control element 5 connects channels. An average speed of the control element 5 at the connecting moment is 10 m/s and the amplitude of the position of the control element is 26.7 mm.

It is to be further stated that the control valve of the invention may also be applied in connection with percussion devices of another kind for breaking rock. As far as the invention is concerned, the point is the control and structure of a working cycle of the control valve, rather than the technique used for producing impact pulses in the percussion device or the device used for breaking rock.

The drawings and the related description are only intended to illustrate the idea of the invention. The details of the invention may vary within the scope of the claims.

The invention claimed is:

1. A control valve for controlling a working cycle of a percussion device comprising a single impact element, the valve comprising:

a frame including a space therein;

at least two pressure medium channels connected to the space;

a control element which is an elongated piece arranged in the space in the frame and which is longitudinally movable in a first control direction and in a second control direction, and further, which control element is arranged to open and close the pressure medium channels when the control element is moved back and forth according to its working cycle;

and wherein the working cycle of the control valve includes several connecting moments in order to open and close the pressure medium channels, and one working cycle of the control valve from a first extreme position to a second extreme position and back is arranged to produce at least two impact pulses in the percussion device.

2. A control valve as claimed in claim 1, wherein the control valve is an elongated sleeve comprising an outer periphery and an inner periphery;

the control valve includes at least one first working pressure space and at least one second working pressure space;

the control valve includes a first control pressure channel in order to feed a pressure medium to the first working pressure space when the control element changes its direction;

the control valve includes a second control pressure channel in order to feed a pressure medium to the second working pressure space when the control element changes its direction;

the control valve includes at least one first working pressure surface arranged to move the control element in the first control direction due to the influence of the pressure medium effective in the first working pressure space;

the control valve includes at least one second working pressure surface arranged to move the control element in the second control direction due to the influence of the pressure medium effective in the second working pressure space, and the working pressure spaces are provided in the space in the frame around the control element.

3. A control valve as claimed in claim 1, wherein the control element comprises at least one connecting element for bringing an external mechanical operating force to the control element.

4. A control valve as claimed in claim 1, wherein the size of apertures to be connected at a connecting moment is dimensioned such that during a working cycle, at each connecting moment the apertures are connected for a substantially equally long time, irrespective of the speed of the control element at the connecting moment.

5. A control valve as claimed in claim 1, wherein the position of apertures to be connected at the connecting moments is dimensioned such that during a working cycle, the time difference between successive opening moments is substantially constant.

6. A control valve as claimed in claim 1, wherein the control valve includes at least two parallel pressure medium channels in which the direction of flow of a pressure medium is the same, and moving the control element in one control direction is arranged to open a connection from the parallel pressure medium channels through the control valve substantially simultaneously.

7. A control valve as claimed in claim 1, wherein one working cycle of the control valve from a first extreme position to a second extreme position and back is arranged to produce four impact pulses in the percussion device.

8. A control valve as claimed in claim 1, wherein one working cycle of the control valve from the first extreme position to the second extreme position and back is arranged to produce six impact pulses in the percussion device.

9. A method of controlling a working cycle of a percussion device, the method comprising:

conveying the pressure of a pressure medium to at least one working pressure surface of a single impact element in the percussion device in order to produce an impact pulse;

using at least one control valve comprising at least a frame and a control element in order to control the pressure medium;

moving the control element according to its working cycle longitudinally in a first control direction and in a second control direction;

opening and closing pressure medium channels leading to the percussion device according to a working cycle of the control element;

and opening and closing the pressure medium channels during one working cycle of the control valve at several connecting moments;

and producing at the percussion device several impact pulses per one working cycle of the control valve.

10. A method as claimed in claim 9, comprising moving the control element by conveying the pressure medium to working pressure surfaces in the control element.

11. A method as claimed in claim 9, comprising moving the control element by means of a crank mechanism.

12. A method as claimed in claim 9, comprising moving the control element by means of a crank mechanism; and adjusting the impact frequency of the percussion device by adjusting the speed of the crank mechanism.

13. A method as claimed in claim 9, comprising producing at the percussion device two impact pulses per one working cycle of the control valve.

14. A method as claimed in claim 9, comprising producing at the percussion device four impact pulses per one working cycle of the control valve.

15. A method as claimed in claim 9, comprising producing at the percussion device six impact pulses per one working cycle of the control valve.

16. A method as claimed in claim 9, comprising conveying via the control valve at least two parallel pressure medium flows and conveying pressure medium flows flowing in the same direction to at least one working pressure surface of the impact element in order to produce an impact pulse.

17. A method as claimed in claim 9, conveying via the control valve at least two parallel pressure medium flows away from at least one working pressure surface of the impact element in order to produce an impact pulse.

18. A percussion device for breaking rock, the percussion device comprising at least:

a frame;

a single impact element which is arranged in a space provided in the frame and which comprises at least one first working pressure surface connected to at least one pressure medium channel so that by affecting the pressure of a pressure medium directed at a working pressure surface, the impact element is arranged to produce impact pulses;

and at least one control valve including a control element which is longitudinally movable and which control element is arranged to affect the feed of the pressure medium of at least one pressure medium channel leading to the impact element, and wherein a working cycle of the control valve includes several connecting moments in order to open and close the pressure medium channels, and one working cycle of the control valve from a first extreme position to a second extreme position and back is arranged to produce at least two impact pulses in the percussion device.

19. A percussion device as claimed in claim 18, wherein the control valve comprises a sleeve-like control element provided with working pressure surfaces, and the control element is arranged to move in a control direction due to the influence of a pressure medium effective on the working pressure surface.

20. A percussion device as claimed in claim 18, wherein the control element is arranged to be moved by means of a crank mechanism.

21. A percussion device as claimed in claim 18, wherein the control element is arranged to be moved by means of a crank mechanism;

the impact frequency of the percussion device is arranged to be adjusted by adjusting the speed of the crank mechanism.

22. A percussion device as claimed in claim 18, wherein the control valve includes at least two parallel pressure medium channels in which the direction of flow of a pressure medium is the same, and moving the control element in one control direction is arranged to open a connection from the parallel pressure medium channels through the control valve substantially simultaneously.

23. A percussion device as claimed in claim 18, wherein one working cycle of the control valve from the first extreme position to the second extreme position and back is arranged to produce four impact pulses in the percussion device.

24. A percussion device as claimed in claim 18, wherein one working cycle of the control valve from the first extreme position to the second extreme position and back is arranged to produce six impact pulses in the percussion device.

25. A percussion device as claimed in claim 18, wherein the impact element is a compression bar, the impact element is arranged to press against the frame of the percussion device due to the influence of the pressure medium conveyed to the working pressure surface so that the impact element is arranged to compress longitudinally, and the control valve is arranged to quickly discharge the pressure medium affecting the working pressure surface so that the impact element obtains its original length and produces an impact pulse.

* * * * *